United States Patent [19]

Kim

[11] Patent Number: 4,789,059

[45] Date of Patent: Dec. 6, 1988

[54] CIGARETTE CASE HAVING AN ASH TRAY

[76] Inventor: Hui Kab Kim, San-1 Songdo-Dong, Pohang-Shi, Kyungsangbuk-Do, Rep. of Korea

[21] Appl. No.: 155,888

[22] Filed: Feb. 16, 1988

[30] Foreign Application Priority Data

Sep. 15, 1987 [KR] Rep. of Korea ..... 87-14033[U]

[51] Int. Cl.[4] ..... B65D 85/10

[52] U.S. Cl. ..... 206/246

[58] Field of Search ..... 206/246

[56] References Cited

U.S. PATENT DOCUMENTS 2,944,555 7/1960 Peel et al. ..... 206/246 X 2,958,417 11/1960 Adams ..... 206/246

3,018,877 1/1962 Posavic ..... 206/246

3,090,482 5/1963 Sandacz ..... 206/246

3,112,029 11/1963 Davey ..... 206/246

*Primary Examiner*—William Price

*Attorney, Agent, or Firm*—Birch, Stewart, Kolasch & Birch

[57] ABSTRACT

A cigarette case which includes an ash tray which is pivotably mounted to the cigarette case for being pulled out therefrom when the ash tray is necessary for use, and a container disposed in the bottom portion thereof for receiving and keeping ash and butts introduced through the ash tray.

3 Claims, 2 Drawing Sheets

CIGARETTE CASE HAVING AN ASH TRAY

BACKGROUND OF THE INVENTION

1. Field of the Invention

The present invention relates to a cigarette case having an ash tray, and more particularly to a cigarette case containing an ash tray which is pivotably mounted to the cigarette case so that the ash tray may be pivotally inserted into the cigarette case and, if it is necessary to use the ash tray, the ash tray is pulled out from the cigarette case.

2. Prior Art of the Invention

Many types of cigarette cases are known in the art. Cigarette cases are also known which provide for easy removal of a cigarette from the cigarette case. However, a cigarette case containing an ash tray pivotally disposed therein has not yet been disclosed.

SUMMARY OF THE INVENTION

Accordingly, it is an object of the present invention to provide an improved cigarette case containing an ash tray disposed therein.

Another object of the present invention is to provide a ash tray insertable into a cigarette case and, wherein the ash tray can be projected from the cigarette case for use.

A further object of the present invention is to provide a cigarette case including a container disposed in the bottom portion thereof for keeping ash and butts therein introduced through a pivotally opening ash tray.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a cigarette case having an ash tray which is pivotably mounted to the cigarette case for being pulled out therefrom when the ash tray is needed for use, and a container disposed in the bottom portion thereof for gathering and keeping ash and butts introduced through the ash tray.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
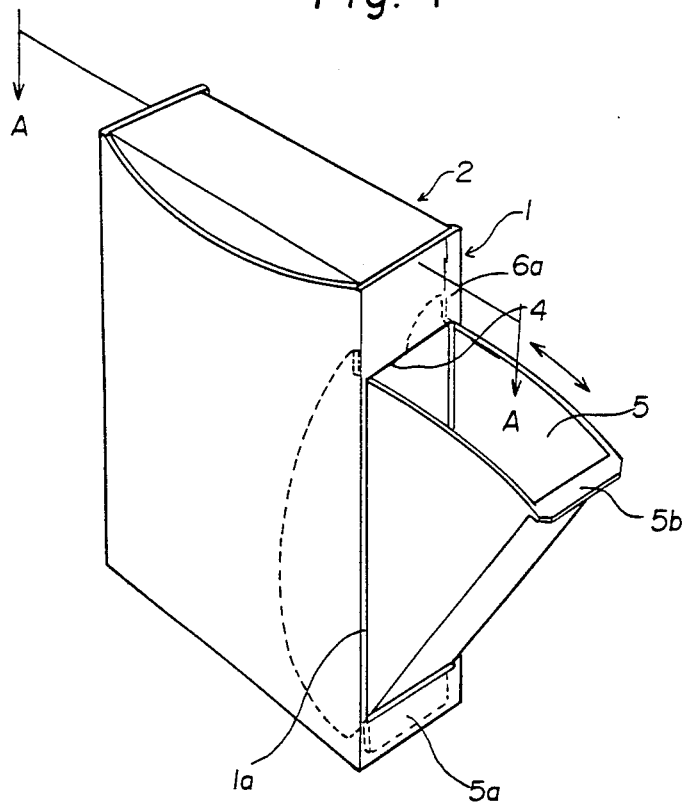
FIG. 1 is a perspective view of a cigarette case having an ash tray of the present invention showing the ash tray in projected position from the cigarette case.
Figure 2:
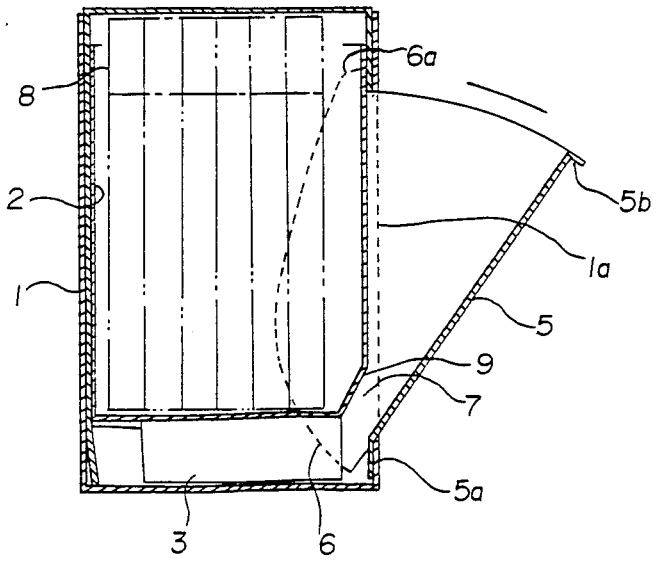
FIG. 2 is a sectional view of FIG. 1 of the present invention.
Figure 3:
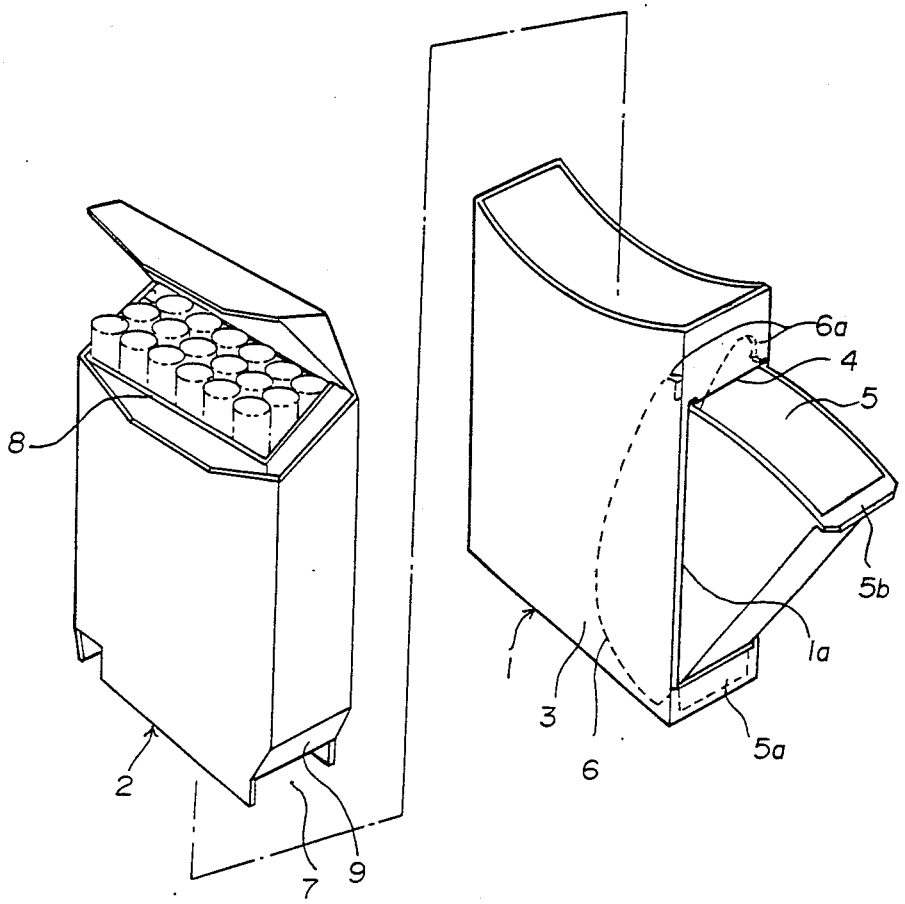
FIG. 3 is an exploded perspective view of the cigarette case having an ash tray according to the present invention.

Referring now in detail to the drawings for the purpose of illustrating preferred embodiments of the present invention, the cigarette case having a ash tray 5 therein as shown in FIGS. 1, 2, and 3 contains an outer case 1 having an outer case aperture 1*a* disposed in one side wall thereof, an inner case 2 including a cigarette package 8 disposed therein, which is inserted into the outer case 1. Furthermore, the cigarette case of the present invention contains the ash tray 5, disposed within the aperture 1*a* of one side wall of the outer case 1, having a spout configuration for inserting into spaces disposed between the outer case 1 and the inner case 2. A container 3 disposed in the bottom portion of the outer case 1 receives and contains ash and butts.

The ash tray 5 is pivotably mounted to the lower portion of one side wall of the outer case 1 of the cigarette case at the lower end portion 5*a* thereof. Also, the ash tray 5 is provided with a handle 5*b* disposed at the top edge portion thereof for pulling the ash tray 5 from the cigarette case. An opening 4 is disposed at the opposite side of the handle 5*b* thereof and the ash tray 5 has the spout configuration. One lower edge 9 of the inner case 2 in the vicinity of the ash tray 5 is formed so that a conduit 7 is formed between the lower edge 9 of the inner case 2 and the lower portion of the ash tray 5 for introducing the ash and butts through a mouthpiece of the ash tray 5. The outer case 1 is provided with a pair of flexible arc members 6 disposed in the interior of the front and rear walls thereof in the vicinity of the ash tray 5 for tightly engaging handle 5*b*. The pair of arc member 6 include an engagement member 6*a* at one end thereof, respectively, for engaging the handle 5*b* of the ash tray 5. The other ends of the pair of arc members 6 are fixed to the lower end portion 5*b* of the ash tray 5.

In operation, the cigarette package 8 is inserted into the inner case 2, and the inner case 2 containing the cigarette package 8 is inserted into the outer case 1 for handy carrying of the cigarette case according to the present invention. When the ash tray 5 is needed for use, for example, in order to dispose of ash and butts during or after smoking, the user pulls the handle 5*b* of the ash tray 5 from the cigarette case and disposes the ash and butts into the ash tray 5. Thus the ash and butts are introduced to the container 3 disposed in the bottom portion of the outer case 1 through the conduit 7. Periodically, the container 3 can be easily cleaned after the inner case 2 is removed from the outer case 1. When the ash tray 5 is inserted into the space disposed between the outer case 1 and the inner case 2, the handle 5*b* of the ash tray 5 is tightly engaged by the engagement ends 6*a* disposed on the pair of flexible arc members 6.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A cigarette case comprising:

an outer case containing an aperture disposed in one side wall thereof, an inner case for receiving a cigarette package which is insertable into said outer case, and said inner case being formed so as to define a conduit between the lower portion of said inner case and said outer case when said inner case is inserted into said outer case, an ash tray having a handle at the upper end portion which is pivotally mounted to the outer case at the lower end portion thereof for being inserted in the spaces disposed between the outer case, and a container disposed in the bottom portion of the outer case which receives ash and butts introduced into the ash tray through the conduit.

2. The cigarette case of claim 1, wherein the outer case is provided with a pair of flexible arc members, said pair of flexible arc members including an engagement end disposed at one end thereof, respectively, for engaging the handle of the ash tray.

3. The cigarette case of claim 1, wherein the ash tray has a spout configuration.

* * * * *